United States Patent [19]

Hayakawa et al.

[11] Patent Number: 4,970,428

[45] Date of Patent: Nov. 13, 1990

[54] DOUBLE-ENDED MINIATURE LAMP

[75] Inventors: Futomi Hayakawa; Kazuo Onoda, both of Tokyo, Japan

[73] Assignee: Kabushiki Kaisha Hybec, Tokyo, Japan

[21] Appl. No.: 335,131

[22] Filed: Apr. 7, 1989

[30] Foreign Application Priority Data

Dec. 26, 1988 [JP] Japan ..... 63-328376

[51] Int. Cl.[5] ..... H01J 1/24; H01J 1/36

[52] U.S. Cl. ..... 313/318; 313/43; 313/623; 313/331

[58] Field of Search ..... 313/318, 623, 624, 331, 313/334, 42, 43

[56] References Cited

U.S. PATENT DOCUMENTS

| | | | |
|---|---|---|---|
| 1,802,167 | 4/1931 | Blank . | |
| 3,265,923 | 8/1966 | Preziosi et al. . | |
| 3,320,466 | 5/1967 | Ayres et al. . | |
| 3,360,765 | 12/1967 | Strange et al. . | |
| 3,855,495 | 12/1974 | Pappas et al. | 313/318 |
| 3,862,397 | 1/1975 | Anderson et al. . | |
| 3,885,186 | 5/1975 | Vause | 313/318 |
| 4,404,491 | 9/1983 | Siaens et al. | 313/318 |

*Primary Examiner*—Kenneth Wieder

*Attorney, Agent, or Firm*—Young & Thompson

[57] ABSTRACT

A double-ended miniature lamp comprises a filament enclosed in a hollow bulb. Lamp lead wires are connected with both the ends of the filament and emerge from closed ends of the bulb. Square-shaped supporting portions of a lamp base consisting of a heat resistant plastic material shape-matingly support at least those closed ends.

10 Claims, 7 Drawing Sheets

DOUBLE-ENDED MINIATURE LAMP

FIELD OF THE INVENTION

The present invention relates to a double-ended miniature or cartridge type lamp utilized, for example, as a back lamp built into electronic instruments, and more particularly to a lamp of this type having a structure which is adapted to be automatically mounted, for example, on a lamp mounting pattern previously provided on a printed circuit board with an automatic machine.

THE PRIOR ART

In the prior art, various structures of this type of lamp have been known, in which the lamp is electrically connected by resting on a lamp mounting pattern previously provided on a printed circuit board.

Such a lamp has been practically used with a structure, for example, as shown in FIGS. 1 and 2 of the accompanying drawings. Such a lamp has, for example, the following dimensions: the overall length of the lamp A =5.84 mm; the outer diameter of a bulb B = 0.93 mm; the length of a terminal cap C = 1.27 mm; the diameter of the terminal cap D = 1.34 mm; and the interval between mounting patterns E = 6.22 mm. The mounting pattern is a square having a side length E = 1.52 mm. In this manner, since the lamp has very small dimensions, it is troublesome to handle, e.g. during assembly.

Specifically, as shown in FIGS. 1 and 2, in such a lamp a bulb 100 is formed in a hollow shape, and adjacent ends of the lamp lead wires 103, 103 are respectively connected to each of the ends of a filament 101 enclosed in said bulb 100. The other ends of the lamp lead wires 103, 103 emerge from closed ends 104, 104 of the bulb 100. On both the ends of the bulb 100 are press-fitted terminal caps 105, 105 through which the lamp lead wires 103, 103 extend and are bent about the outer peripheries of the terminal caps 105, 105, as shown in FIG. 2. Thus bent, the lamp lead wires are welded by their bent ends 106 on mounting patterns of a printed board.

However, in this type of lamp, since the terminal caps fitted on both ends of the bulb are circular in section, they are very unstable in its circumferential direction. Therefore, upon mounting the lamp on the mounting patterns of the printed board, if the bent portion of the lamp lead wire rests on the pattern, it is very unstable, and consequently upon welding, the lamps must be held and applied one by bone and it is difficult to perform the welding work. Therefore, if it is desired to automatically mount such lamps with an automatic machine, it has been impossible to automatically mount them using the terminal cap having a circular shape, due to the problem of stability when the lamp rests on the mounting pattern. Also, because the terminal cap is press-fitted directly on the closed end of the bulb, damage or breakage of the bulb often occurs upon press-fitting. Furthermore, because the lamps tend to e microscopic, the terminal cap often is bent when press-fitted to the bulb. Therefore, when the terminal cap rests on the mounting pattern, the lamp is not horizontal, and a gap is formed between the terminal cap and the mounting pattern, whereby electrical connection is prevented.

In order to solve the above problems, the present inventors proposed a lamp of this type adapted to be automatically mounted on the mounting pattern by forming a flat surface on the terminal cap that rests on the mounting pattern of the printed board (Japanese Patent Appln. No. 62-134036 (No. 134036/1987)).

OBJECTS OF THE INVENTION

The objects of the present invention are to provide a lamp of the above type, which can be automatically mounted on a mounting pattern and which is easy to center and assemble, and to provide such a lamp in which the bulb is fully protected and which is durable.

BRIEF SUMMARY OF THE INVENTION

In order to achieve the above objects, according to the present invention, there is provided a lamp which comprises a filament enclosed in a hollow bulb, lamp lead wires which are connected with both the ends of said filament and which emerge from closed ends of said bulb, and square shaped supporting portions of a lamp base consisting of a heat resistant plastic material supporting at least the closed ends of the bulbs, whereby a contact surface of said square shaped supporting portions is provided and said lamp lead wires are electrically connected to that surface.

The supporting portion of the lamp base is preferably formed in a shape to match the outer peripheral surface of the closed ends of the bulb.

In order to allow the easy centering of the lamp, the lamp base is preferably formed with a bulb-receiving portion of U-shape in section at a central portion of the longitudinal direction thereof.

In order to help cool the bulb, a cooling recess is preferably formed as a step down from the bulb-receiving portion along the longitudinal direction of the lamp base.

In order to prevent the lead wires from deviating along the outer surface of the square-shaped supporting portion, it is preferable to form a groove which is provided along the upper, end and lower surfaces of the square-shaped supporting portion of the lamp base so as to receive the lead wires.

In order to protect the bulb, it is preferable to fit a terminal cap on a square-shaped supporting portion of the lamp base.

In order to abbreviate the terminal cap, it is preferable that an epoxy resin paint or the like be coated on the outer peripheral surface of the square-shaped supporting portion of the lamp base and that a lead wire emerging from the closed end of the bulb be soldered on the coating surface.

In order to abbreviate the terminal cap, it is preferable that the square-shaped supporting portions of the lamp base support envelop the closed ends of the bulb and the lead wires emerging from the closed ends and that the squareshaped supporting portions be formed from an electrically conductive material having a quadrangular shape in section.

In order to abbreviate the terminal cap, it is preferable that the closed ends of the bulb and the lamp lead wires emerging from the closed ends be coated with an electrically conductive material.

The present invention will be described below in detail with respect to embodiments shown in the drawings.

DETAILED DESCRIPTION OF THE INVENTION

Figure 1:
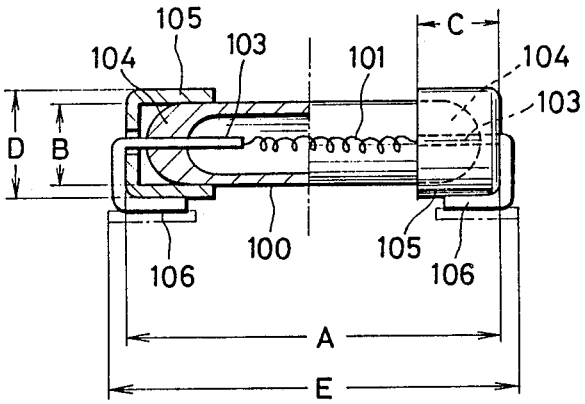
FIG. 1 (PRIOR ART)
FIGS. 1 is a front view showing a prior art lamp.
Figure 2:
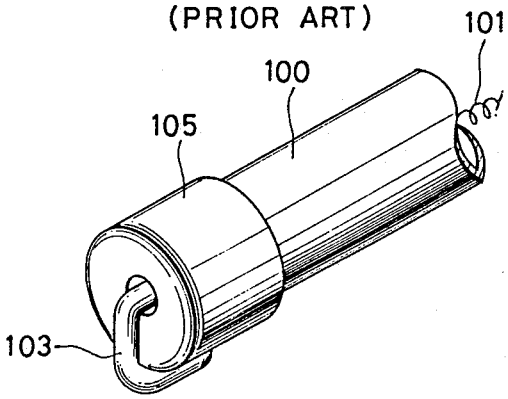
FIG. 2 (PRIOR ART)
FIG. 2 is an enlarged perspective view showing a lamp lead wire emerging from the lamp of FIG. 1.
Figure 3:
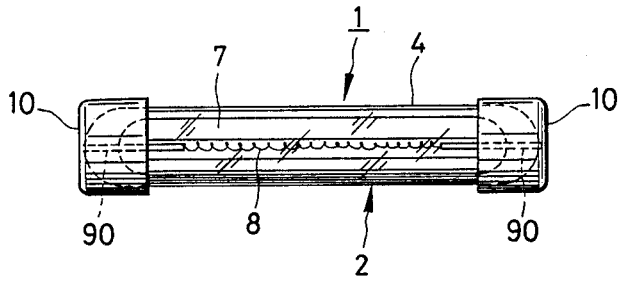
FIG. 3 is a plan view showing a lamp according to one embodiment of the present invention.

Referring to FIGS. 3 to 7, there is shown on embodiment of the present invention illustrating a double-ended miniature or cartridge type lamp indicated generally by reference numeral 1. Each of the dimensions of the lamp is substantially equal to those of the lamp shown in FIG. 1 and the corresponding description thereof is accordingly abbreviated. Reference numeral 2 shows a lamp base which is molded in a substantially rectangular shape as a whole from a heat resistant plastic, for example, epoxy resin. The lamp base 2 is provided with square-shaped supporting portions 3, 3 at both ends in the longitudinal direction thereof. These supporting portions 3, 3 are of square section. On the lamp base 2 is formed a lamp-receiving portion 5 of U-shape section which has wall surfaces 4, 4 confronting each other along the longitudinal direction of the lamp base 2. Inside an inner bottom portion of the lamp-receiving portion 5 is provided a cooling recess 6 stepped down from the inner bottom portion of the U-shaped portion 5 along the longitudinal direction thereof. Into the lamp-receiving portion 5 is inserted an elongated bulb 7 which has a circular section. In the bulb 7 is enclosed a filament 8 at both ends of which adjacent ends of lamp lead wires 9, 9 are connected. The other ends of wires 9 are drawn out through closed ends 70, 70 of the bulb 7 which in these regions is formed in an arcuate section. Accordingly, the centering of the lamp is easily effected by dropping the bulb 7 into the recess portion 5 and by inserting the closed ends 70, 70 into the square-shaped supporting portions 3, 3 to support the in the latter. Lead wires 90, 90 extending from the closed ends 70, 70 are bent about the underside of the square-shaped supporting portions 3, 3. Quadrangular terminal caps 10, 10 enclose the supporting portions 3, 3, the terminal caps 10, 10 allowing the lamp lead wires 90, 90 to extend parallel to the supporting portions 3, 3.

Figure 8:
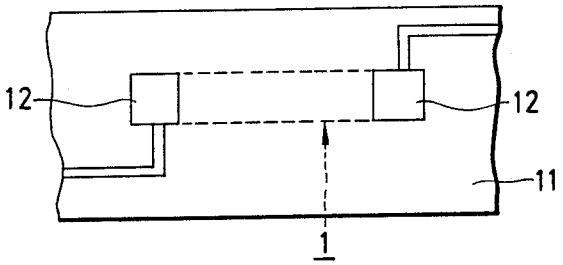
FIG. 8 is a fragmentary plan view showing a mounting pattern for mounting the lamp.

The lamp 1 constructed as mentioned above is so shaped, for example as shown in FIG. 8, that the terminal caps 10, 10 of the lamp 1 can be secured to mounting patterns 12, 12 previously provided on a printed circuit board 11. In this case, because the terminal caps 10, 10 have nothing but flat surfaces, the terminal caps 10, 10 rest on the mounting patterns 12, 12 in a very stable state without moving arbitrarily thereon. Accordingly, welding may be effected as usual in this condition. When an automatic machine is used in order to secure the terminal caps 10, 10 of the lamp 1 on the mounting patterns 12, 12, the lamp 1 can be separably adhered in a series on a tape. Thereafter, the lamps are removed one by one from the tape by the automatic machine so as to transfer them onto the patterns 12, 12, the welding being then performed.

Figure 9:
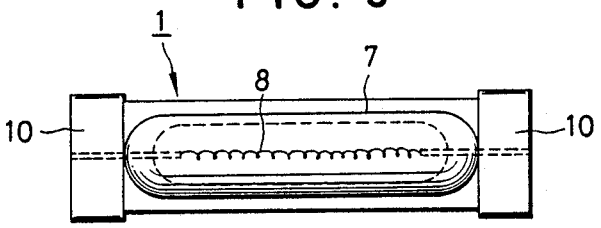
FIG. 9 is a plan view showing a second embodiment of lamp according to the present invention.

Next will be described a second embodiment of the present invention with reference to FIGS. 9 to 11.

In this embodiment, a lamp base 2 has a lamp receiving portion 5 which is shallower than that of the first embodiment. Accordingly, when a bulb 7 is accommodated in the receiving portion 5, only the lower half, below the central filament 8 is embedded and the upper half of the bulb 7 protrudes upwardly between the terminal caps 10. Lead wires 90, 90 are positioned between the upper surfaces of the square supporting portions 3, 3, and the inner surfaces of the terminal caps 10, 10 that are fitted onto the supporting portions 3, 3. The terminal caps 10, 10 are open at both ends thereof and are split at 13. In this embodiment, the cradle provided for bulb 7 by supporting portions 3, 3 is shaped as two short arcs in cross section.

Figure 12:
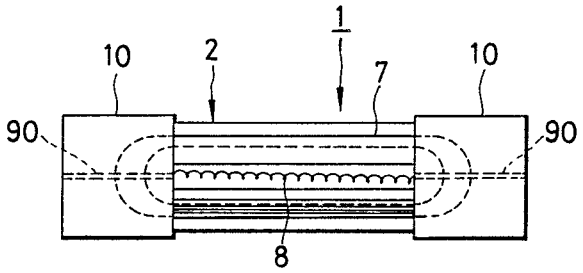
FIG. 12 is a plan view showing a third embodiment of lamp according to the present invention.
Figure 13:
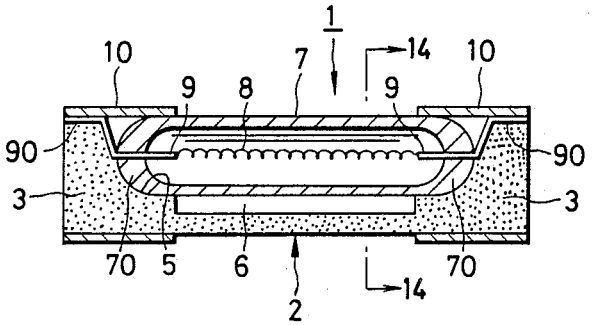
FIG. 13 is a longitudinal cross-sectional view of the lamp of FIG. 12.
Figure 14:
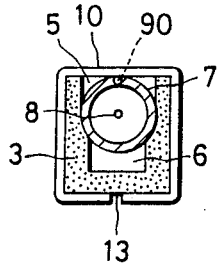
FIG. 14 is a cross-sectional view taken along line 14—14 of FIG. 13.

A third embodiment will now be described with reference to FIGS. 12 to 14.

In this embodiment, a bulb-receiving portion 5 formed in a lamp base 2 is deeper than that of the second embodiment. Accordingly, when a bulb 7 is received in the receiving portion 5, the whole bulb 7 is embedded entirely in the receiving portion 5. Therefore, when terminal caps 10, 10 are fitted onto square-shaped supporting portions 3, 3 of the lamp base 2, closed ends 70, 70 of the bulb 7 are disposed between bulb supporting portions 3, 3 and the inner surfaces of the terminal caps 10, 10. The bulb 7 is fully accommodated in the lamp base 2 and so is well protected.

A fourth embodiment shown in FIGS. 15 and 16 will now be described.

This fourth embodiment does not use terminal caps. In this embodiment, square-shaped supporting portions 3, 3 of a lamp base 2 are arranged to envelop closed ends 70, 70 of a bulb 7. The square-shaped supporting portions 3, 3 are formed from electrically conductive material.

Figure 17:
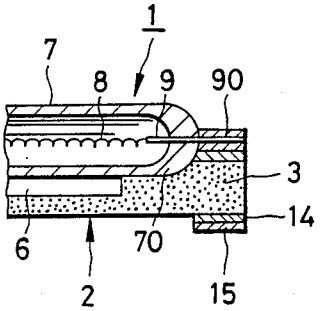
FIG. 17 is a partial longitudinal cross-sectional view of a fifth embodiment of lamp according to the present invention.
Figure 18:
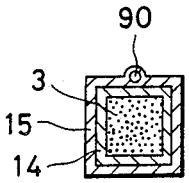
FIG. 18 is an end view of FIG. 17 seen from its right side.

Next will be described a fifth embodiment shown in FIGS. 17 and 18.

Figure 10:
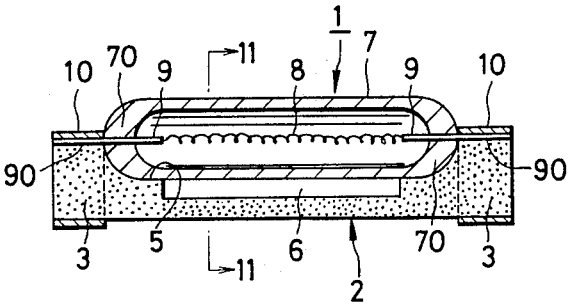
FIG. 10 is a longitudinal cross-sectional view of FIG. 9.
Figure 11:
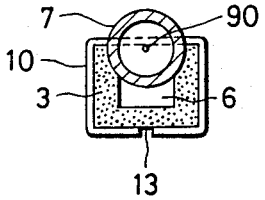
FIG. 11 is a cross-sectional view taken along line II—II of FIG. 10.

In this embodiment, a structure is provided in which square-shaped supporting portions 3, 3 of a lamp base 2 cradle closed ends 70, 70 of a bulb 7, similarly to the structure described with respect to FIG. 10. On an outer periphery of the square-shaped supporting portion 3 is coated a laser 14 of an electrically conductive material, for example, a low melting point glass. A lamp lead wire 90 emerging from the closed end 70 overlies and is spaced from the coating layer 14, and an electrical connection between 90 and 14 is provided by solder 15. Accordingly, a terminal cap is unnecessary in this embodiment.

Figure 19:
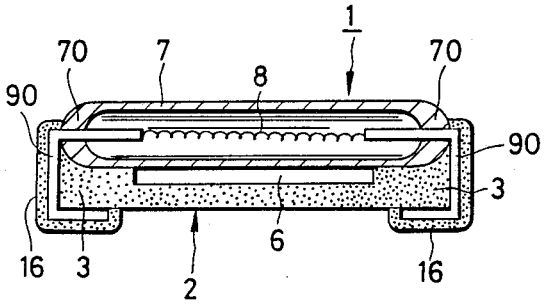
FIG. 19 is a longitudinal cross-sectional view showing a sixth embodiment of lamp according to the present invention.
Figure 20:
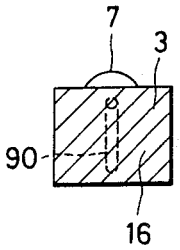
FIG. 20 is an end view of FIG. 19.

A sixth embodiment shown in FIGS. 19 and 20 will now be described.

Figure 15:
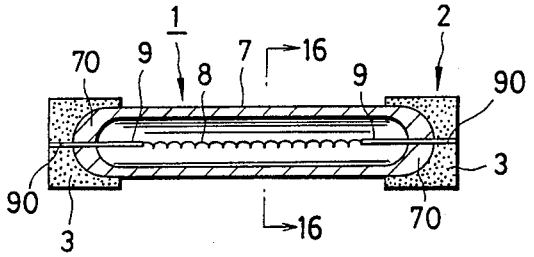
FIG. 15 is a longitudinal cross-sectional view showing a fourth embodiment of lamp according to the present invention.
Figure 16:
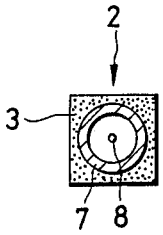
FIG. 16 is a cross-sectional view taken along line 16—16 of FIG. 15.

This embodiment also, like the embodiment of FIGS. 15 and 16, does not use terminal caps. In this embodiment, coatings 16, 16 of electrically conductive material are provided, which entirely cover the lamp wires 90, 90 emerging from closed ends 70, 70 and the square-shaped supporting portions 3, 3.

Figure 21:
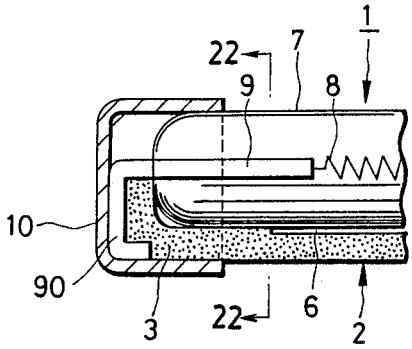
FIG. 21 is a partial longitudinal sectional view showing a seventh embodiment of lamp according to the present invention.
Figure 22:
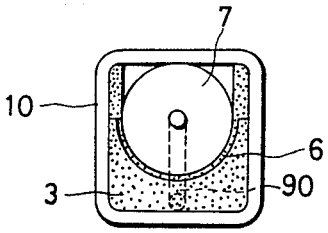
FIG. 22 is a cross-sectional view taken along line 22—22 of FIG. 21.
Figure 23:
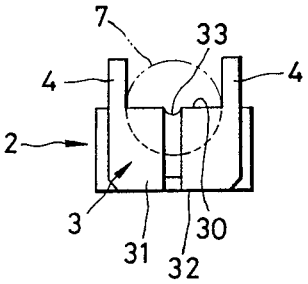
FIG. 23 is an end view showing a square-shaped supporting portion of FIGS. 21 and 22.

Finally, a seventh embodiment of the present invention will be described with respect to FIGS. 21 to 23.

Figure 4:
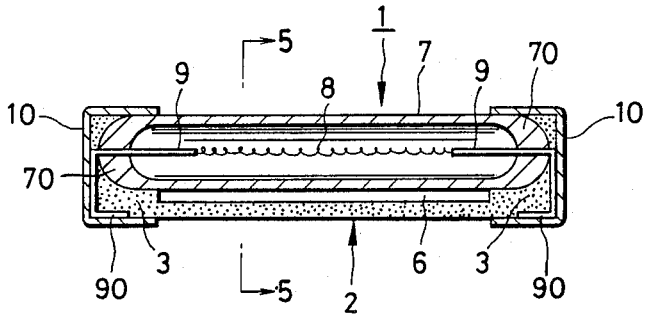
FIG. 4 is a longitudinal cross-sectional view of FIG. 3.
Figure 5:
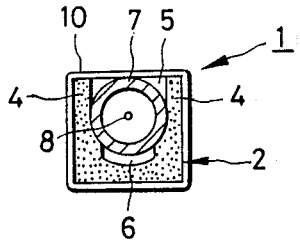
FIG. 5 is a cross-sectional view taken along line 5—5 of FIG. 4.
Figure 6:
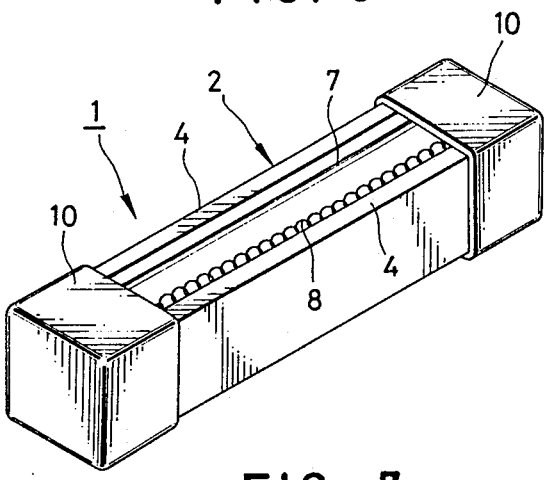
FIG. 6 is a perspective view showing the assembled condition of the lamp.
Figure 7:
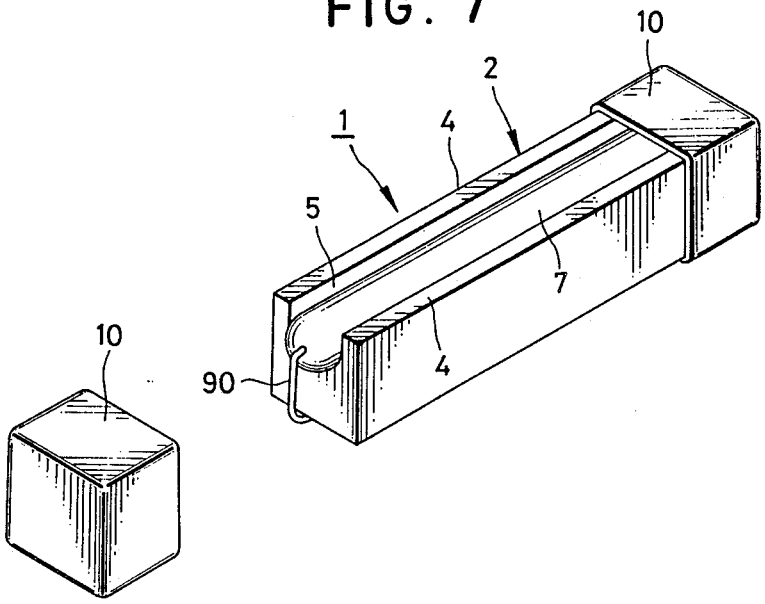
FIG. 7 is an exploded perspective view similar to FIG. 6 but showing one terminal cap removed.

The seventh embodiment somewhat resembles the embodiment shown in FIG. 4 in that it provides a structure in which a lead wire 90 extends about the outer surface of a square-shaped supporting portion 3. In this embodiment, however, a groove 33 is formed over an upper surface 30, an end surface 31 and a lower surface 32 of portion 3. This groove may be, for example, semicircular, square-shaped or the like in its section. In this groove 33 is inserted the wire 90 emerging from a bulb 7 and a terminal cap 10 is fitted on the square-shaped supporting portion 3 as in the previous embodiments.

Lamps thus constructed have the following advantages:

(1) Because the lamp is carried on the mounting pattern of the printed board in a very stable state, it is possible to automatically mount the lamp on the mounting pattern by an automatic machine.

(2) Because the closed ends of the bulb are formed to mate with the supporting portion of the lamp base, the supporting surfaces are tightly fitted to each other and the bulb is protected without any play. Consequently, the bulb can be supported strongly and stably.

(3) Because the lamp base has a bulb-receiving portion which is formed in a U-shaped section, the centering of the lamp is easily effected merely by dropping the bulb into the receiving position.

(4) Because a stepped recess for cooling is formed in the bulb-receiving portion along the longitudinal direction of the lamp base, the cooling of the bulb is augmented.

(5) Because the bulb is embedded in the bulb-receiving portion and the closed ends of the bulb are supported by the square-shaped supporting portions and the terminal caps fit over the latter, the bulb is strongly and stably supported.

(6) If electrically conductive material is coated on the outer periphery of the square-shaped supporting portion of the lamp base and the lead wires emerging from the closed ends of the bulb are soldered on the coating surface, the terminal caps cannot be removed and it is possible to reduce the number of parts and to abbreviate the assembling process.

(7) If the square-shaped supporting portion of the lamp base envelops the closed ends of the bulb and the lead wires are coated with electrically conductive material to form a square shape in section, it is possible to abbreviate the terminal cap and not to necessitate the centering of the bulb.

(8) If a groove is formed over the upper, end and lower surfaces on the outer surface of the square shape supporting portion of the lamp base and the lead wire is inserted in the groove, the lead wire is stably positioned.

What is claimed is:

1. A double-ended miniature lamp comprising a filament enclosed in a hollow bulb; lamp lead wires which are connected with both the ends of said filament and which emerge from closed ends of said bulb; and square-shaped supporting portions of a lamp base consisting of a heat resistant plastic material shape-matingly supporting at least said closed ends.

2. A lamp as set forth in claim 1, wherein said square-shaped supporting portions of the lamp base have inner supporting surfaces shaped as concave arcuate surfaces and outer peripheral surfaces of said closed ends of said bulb have convex arcuate surfaces mating therewith.

3. A lamp as set forth in claim 1, wherein said supporting portions are integral with each other and a bulb-receiving portion is formed therein with a U-shaped section that extends longitudinally of said lamp base.

4. A lamp as set forth in claim 3, wherein a recess for cooling is formed as a step down from said bulb-receiving portion along the longitudinal direction of said lamp base.

5. A lamp as set forth in claim 1, wherein said closed ends of said bulb are supported by said square-shaped supporting portions and by terminal caps fitting over said square-shaped supporting portions of said lamp base.

6. A lamp as set forth in claim wherein an electrically conductive material is coated on an outer peripheral surface of said square-shaped supporting portions of said lamp base and said lamp lead wires are soldered on said coated surface.

7. A lamp as set forth in claim 1, wherein said square-shaped supporting portions of said lamp base support envelop said closed ends of said bulb and said lamp lead wires and are constituted by an electrically conductive material.

8. A lamp as set forth in claim 1, which is partially coated with an electrically conductive material to envelop said closed ends of said bulb and said lamp lead wires.

9. A lamp s set forth in claim 5, said terminal caps being electrically conductive and said lead wires being in electrical contact with said terminal caps.

10. A lamp as set forth in claim 9, said lead wires terminating within said terminal caps.

* * * * *